US007446740B2

(12) United States Patent
Jung

(10) Patent No.: US 7,446,740 B2
(45) Date of Patent: Nov. 4, 2008

(54) IMAGE DISPLAY DEVICE AND DRIVING METHOD THEREOF

(75) Inventor: Jin-Tae Jung, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 648 days.

(21) Appl. No.: 10/992,648

(22) Filed: Nov. 22, 2004

(65) Prior Publication Data

US 2005/0140605 A1 Jun. 30, 2005

(30) Foreign Application Priority Data

Nov. 24, 2003 (KR) ..... 10-2003-0083581

(51) Int. Cl.
*G09G 3/30* (2006.01)

(52) U.S. Cl. ..... 345/76; 345/77; 345/78

(58) Field of Classification Search ..... 345/76–78, 345/82, 204, 211, 690, 692, 92, 87, 90; 257/59, 257/350, 351; 315/169.3; 313/483, 498
See application file for complete search history.

(56) References Cited

U.S. PATENT DOCUMENTS

| | | | | |
|---|---|---|---|---|
| 6,919,871 | B2 * | 7/2005 | Kwon | 345/92 |
| 7,015,884 | B2 * | 3/2006 | Kwon | 345/78 |
| 7,046,220 | B2 * | 5/2006 | Tagawa et al. | 345/76 |
| 7,057,589 | B2 * | 6/2006 | Shin et al. | 345/82 |
| 7,079,094 | B2 * | 7/2006 | Tokioka et al. | 345/82 |
| 7,106,319 | B2 * | 9/2006 | Ishiyama | 345/211 |
| 7,109,952 | B2 * | 9/2006 | Kwon | 345/76 |
| 7,145,530 | B2 * | 12/2006 | Miyazawa | 345/76 |
| 7,205,967 | B2 * | 4/2007 | Morishige et al. | 345/76 |
| 7,256,756 | B2 * | 8/2007 | Abe | 345/76 |
| 2003/0227262 | A1 * | 12/2003 | Kwon | 315/169.3 |
| 2004/0070557 | A1 * | 4/2004 | Asano et al. | 345/76 |
| 2004/0196224 | A1 * | 10/2004 | Kwon | 345/82 |
| 2004/0196239 | A1 * | 10/2004 | Kwon | 345/92 |
| 2004/0251846 | A1 * | 12/2004 | Choi et al. | 315/169.3 |
| 2006/0214890 | A1 * | 9/2006 | Morishige et al. | 345/77 |

FOREIGN PATENT DOCUMENTS

| | | |
|---|---|---|
| JP | 2003-066905 | 3/2003 |
| JP | 2003-195809 | 7/2003 |
| JP | 2003-223138 | 8/2003 |
| JP | 2005-128521 | 5/2005 |

* cited by examiner

*Primary Examiner*—Prabodh Dharia
(74) *Attorney, Agent, or Firm*—H.C. Park & Associates, PLC

(57) ABSTRACT

An image display device comprises a pixel circuit including a display element; a first transistor for controlling a current output to a third electrode according to a voltage applied between the first and second electrodes; a first switch for diode-connecting the first transistor in response to a select signal; a first capacitor; a second switch for coupling a first electrode of the first capacitor to a power in response to the select signal; a second capacitor; a third switch for transmitting the data voltage to a second electrode of the second capacitor in response to the select signal; and a fourth switch for intercepting the first electrode of the first capacitor and the second electrode of the second capacitor in response to the select signal.

17 Claims, 6 Drawing Sheets

IMAGE DISPLAY DEVICE AND DRIVING METHOD THEREOF

This application claims priority to and the benefit of Korea Patent Application No. 10-2003-0083581, filed on Nov. 24, 2003, which is hereby incorporated by reference for all purposes as if fully set forth herein.

BACKGROUND OF THE INVENTION

1. Field of the Invention

The present invention relates to an image display device and driving method thereof. More specifically, the present invention relates to an organic EL (electroluminescent) display device.

2. Discussion of the Related Art

Generally, an organic EL display electrically excites a phosphorous organic compound to emit light, and it voltage- or current-programs N×M emitting cells to display images. As shown in FIG. 1, a typical organic emitting cell comprises an anode (made of indium tin oxide (ITO)), an organic thin film, and a cathode layer (metal). The organic thin film may have a multi-layer structure including an emitting layer (EML), an electron transport layer (ETL), and a hole transport layer (HTL), an electron injecting layer (EIL) and a hole injecting layer (HIL).

Methods for driving organic emitting cells include the passive matrix method, and the active matrix method, which uses thin film transistors (TFTs) or metal-oxide-semiconductor field-effect transistors (MOSFETs). The passive matrix method forms crossing cathodes and anodes and selectively drives data and scan lines. The active matrix method couples a TFT and a capacitor to each ITO pixel electrode to maintain the voltage by utilizing the capacitor. The active matrix method includes a voltage programming method or a current programming method, depending upon signal forms supplied for programming a voltage at a capacitor.

FIG. 2 shows a conventional voltage programming pixel circuit for driving an organic EL element.

As shown, the conventional voltage programming pixel circuit comprises transistors M1, M2, M3, and M4, capacitors C1 and C2, and an organic EL element OLED. The data line Dm transmits data voltages for displaying image signals to the pixel circuit, the capacitor C2 is coupled to the power $V_{DD}$, and a cathode of the organic EL element OLED is coupled to a power $V_{SS}$. A threshold voltage of $V_{TH}$ at the driving transistor M1 is compensated by select signals provided from three scan lines $S_n$, AZ, and AZB, and a current corresponding to a data voltage $V_{DATA}$ is controlled to flow to the organic EL element OLED.

The conventional pixel circuit compensates for deviation of the threshold voltage $V_{TH}$ of the driving transistor M1, but requires three additional scan lines for such compensation. This many scan lines may degrade the display device's aperture ratio and provide a complicated driving circuit.

SUMMARY OF THE INVENTION

The present invention provides a pixel circuit of an image display device with less signal lines.

The present invention also provides an image display device with an improved aperture ratio by simplifying a driving circuit and a pixel circuit.

The present invention also provides an image display device with accurately compensated deviation of a threshold voltage at a driving transistor.

Additional features of the invention will be set forth in the description which follows, and in part will be apparent from the description, or may be learned by practice of the invention.

The present invention discloses an image display device including a plurality of data lines for transmitting a data voltage corresponding to an image signal, a plurality of scan lines for transmitting a select signal, and a pixel circuit coupled to a data line and a scan line. The pixel circuit comprises a display element for displaying an image corresponding to an applied current, and a first transistor, including a first electrode, a second electrode coupled to a power, and a third electrode coupled to the display element, for outputting a current corresponding to a voltage applied between the first and second electrodes to the third electrode. A first switch diode-connects the first transistor in response to the select signal provided from the scan line, and a second switch couples a first electrode of a first capacitor to the power in response to the select signal provided from the scan line. A second electrode of the first capacitor is coupled to the first electrode of the first transistor, and a second capacitor has a first electrode coupled to the power. A third switch transmits the data voltage to a second electrode of the second capacitor in response to the select signal provided from the scan line. A fourth switch, coupled between the first electrode of the first capacitor and the second electrode of the second capacitor, intercepts the first electrode of the first capacitor and the second electrode of the second capacitor in response to the select signal provided from the scan line.

The present invention also discloses an image display device including a plurality of data lines for transmitting a data voltage corresponding to an image signal, a plurality of first scan lines for transmitting a select signal, a plurality of second scan lines for transmitting a control signal, and a pixel circuit coupled to a data line, a first scan line, and a second scan line. The pixel circuit comprises a display element for displaying an image corresponding to an applied current, and a first transistor, including a first electrode, a second electrode coupled to a power, and a third electrode coupled to the display element, for outputting a current corresponding to a voltage applied between the first and second electrodes to the third electrode. A first switch diode-connects the first transistor in response to a first control signal, and a second switch couples a first electrode of the first capacitor to the power in response to a second control signal. A second electrode of the first capacitor is coupled to the first electrode of the first transistor, and a second capacitor has a first electrode coupled to the power. A third switch transmits the data voltage to a second electrode of the second capacitor in response to the select signal provided from the scan line. A fourth switch, coupled between the first electrode of the first capacitor and the second electrode of the second capacitor, intercepts the second electrode of the first capacitor and the second electrode of the second capacitor in response to a third control signal.

The present invention also discloses a method for an image display device. The image display device includes a plurality of data lines for transmitting a data voltage corresponding to an image signal, a plurality of scan lines for transmitting a select signal, and a pixel circuit coupled to a data line and a scan line. The pixel circuit comprises a driving transistor having a first electrode, a second electrode coupled to a power, and a third electrode, and it outputs a current corresponding to a voltage applied between the first and second electrodes to the third electrode. A display element is coupled to the third electrode of the driving transistor and displays an image in correspondence to an amount of the applied current.

A first capacitor has a second electrode coupled to the first electrode of the driving transistor, and a second capacitor has a first electrode coupled to the power. A method for driving such an image display device comprises diode-connecting the driving transistor, coupling a first electrode of the first capacitor to the power, and coupling a second electrode of the second capacitor to the data line during a first period. The first electrode of the first capacitor and the second electrode of the second capacitor are coupled during a second period.

The present invention also discloses a driving method of an image display device. The image display device includes a plurality of data lines for transmitting a data voltage corresponding to an image signal, a plurality of first scan lines for transmitting a select signal, a plurality of second scan lines for transmitting a control signal, and a pixel circuit coupled to a data line, a first scan line, and a second scan line. The pixel circuit comprises a driving transistor having a first electrode, a second electrode coupled to a power, and a third electrode, and it outputs a current corresponding to a voltage applied between the first and second electrodes to the third electrode. A display element is coupled to the third electrode of the driving transistor and displays an image in correspondence to an amount of the applied current. A first capacitor has a second electrode coupled to the first electrode of the driving transistor, and a second capacitor has a first electrode coupled to the power. A method for driving such an image display device comprises diode-connecting the driving transistor, and coupling a first electrode of the first capacitor to the power during a first period. A second electrode of the second capacitor is coupled to the data line during a second period, and the first electrode of the first capacitor is coupled to the second electrode of the second capacitor during a third period.

The present invention also discloses a driving method of an image display device. The image display device includes a plurality of data lines for transmitting a data voltage corresponding to an image signal, a plurality of scan lines for transmitting a select signal, and a pixel circuit coupled to a data line and a scan line. The pixel circuit comprises a driving transistor having a first electrode, a second electrode coupled to a power, and a third electrode. A display element is coupled to the third electrode of the driving transistor. A first capacitor has a second electrode coupled to the first electrode of the driving transistor, and a second capacitor has a first electrode coupled to the power. The method for driving such an image display device comprises storing a threshold voltage at the driving transistor in the first capacitor and storing a data voltage in the second capacitor during a first period. The first capacitor and the second capacitor are coupled in series so that the voltage stored in the first capacitor and the voltage stored in the second capacitor may be applied to the first electrode of the driving transistor during a second period.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figure 1:
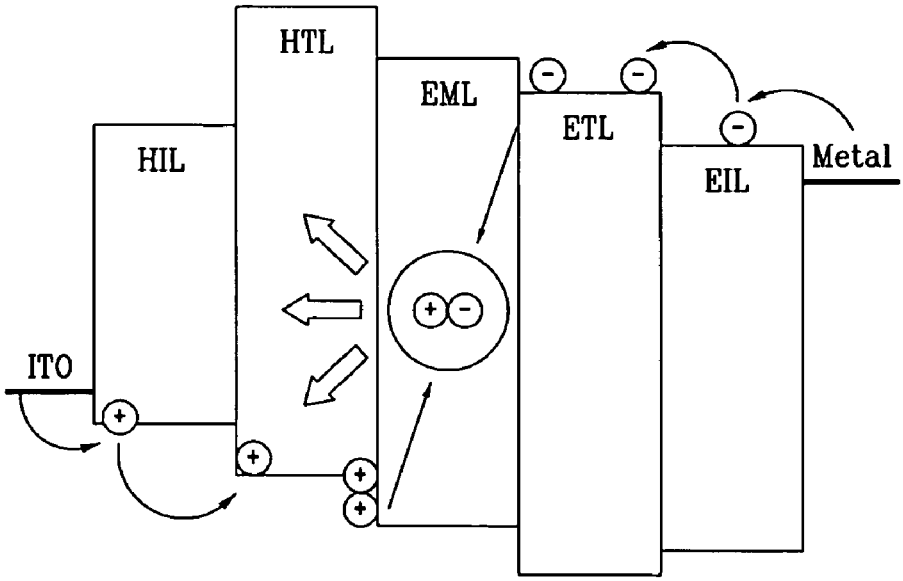
FIG.1(Prior Art)
FIG. 1 shows a conceptual diagram of an organic EL display element.
Figure 2:
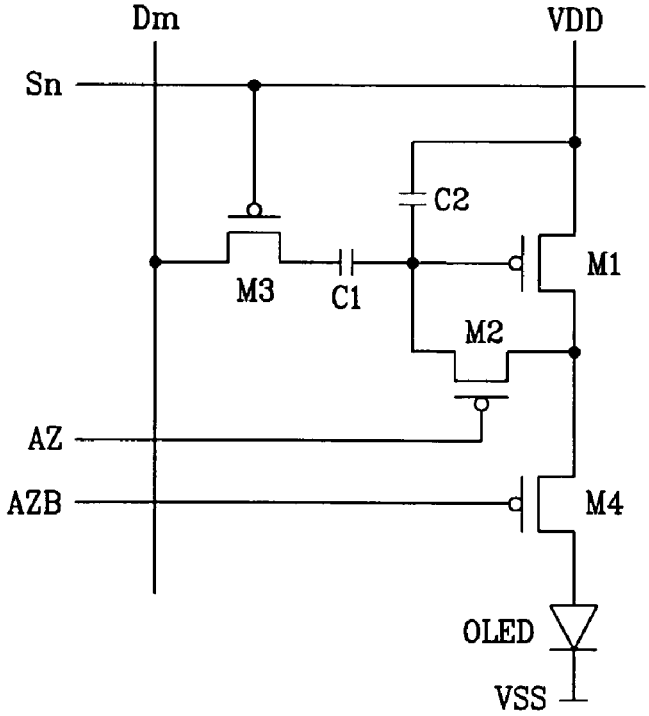
FIG.2(Prior Art)
FIG. 2 shows a conventional voltage programming pixel circuit for driving an organic EL element.

In the following detailed description, only the preferred embodiment of the invention has been shown and described, simply by way of illustration of the best mode contemplated by the inventor(s) of carrying out the invention. As will be realized, the invention is capable of modification in various obvious respects, all without departing from the invention. Accordingly, the drawings and description are to be regarded as illustrative in nature, and not restrictive.

To couple one thing to another includes to directly couple the first one to the second one and to couple the first one to the second one with others provided therebetween. To clarify the present invention, parts which are not described in the specification are omitted, and parts for which similar descriptions are provided have the same reference numerals.

Figure 3:
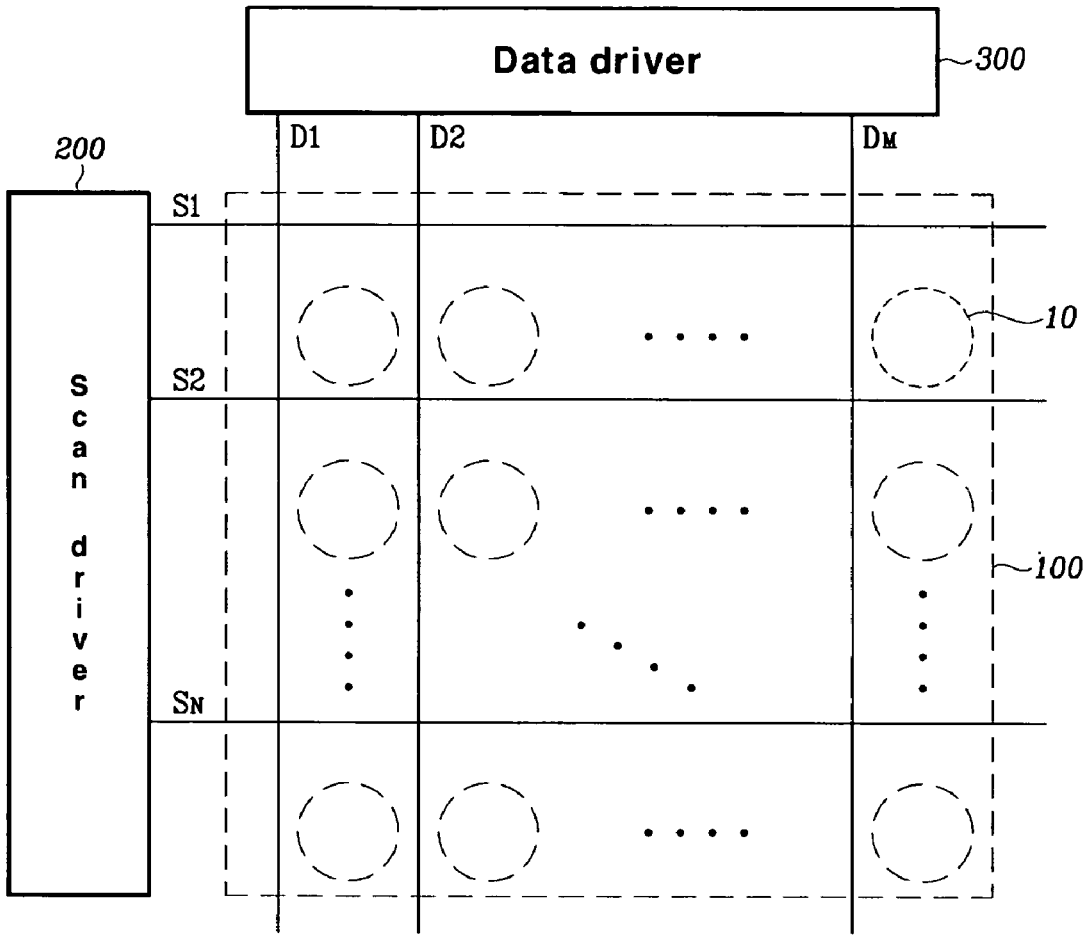
FIG. 3 shows an image display device according to an exemplary embodiment of the present invention.

FIG. 3 shows an organic EL display device according to an exemplary embodiment of the present invention.

As shown, the organic EL display device comprises an organic EL display panel 100, a scan driver 200, and a data driver 300.

The organic EL display panel 100 comprises a plurality of data lines $D_1$ to $D_M$ in the column direction, a plurality of scan lines S1 to $S_N$ in the row direction, and a plurality of pixel circuits 10. The data lines D1 to $D_M$ transmit data voltages for displaying image signals to the pixel circuit 10, and the scan lines S1 to $S_N$ transmit select signals to the pixel circuit 10. The pixel circuit 10 is formed at a pixel area defined by two adjacent data lines D1 to $D_M$, and two adjacent scan lines S1 to $S_N$.

The scan driver 200 sequentially applies select signals to the scan lines S1 to $S_N$, and the data driver 300 applies the data voltage for displaying image signals to the data lines D1 to $D_M$.

The scan driver 200 and/or the data driver 300 may be coupled to the display panel 100, or they may be installed, in a chip format, or in a tape carrier package (TCP), coupled to the display panel 100. They may also be attached to the display panel 100, and installed, in a chip format, on a flexible printed circuit (FPC) or a film coupled to the display panel 100. On the other hand, the scan driver 200 and/or the data driver 300 may be installed on the glass substrate of the display panel. Specifically, they may be substituted for the driving circuit formed in the same layers of the scan lines, the data lines, and TFTs on the glass substrate, or they may be directly installed on the glass substrate.

Referring to FIG. 4, FIG. 5, FIG. 6 and FIG. 7, the pixel circuit 10 of the organic EL display device according to the first exemplary embodiment will be described.

Figure 4:
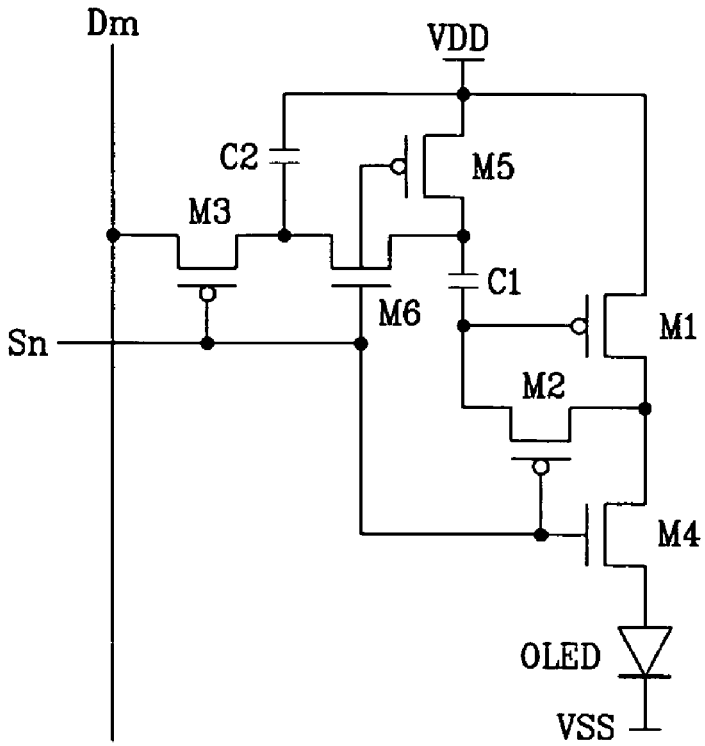
FIG. 4 shows a pixel circuit according to a first exemplary embodiment of the present invention.
Figure 5:
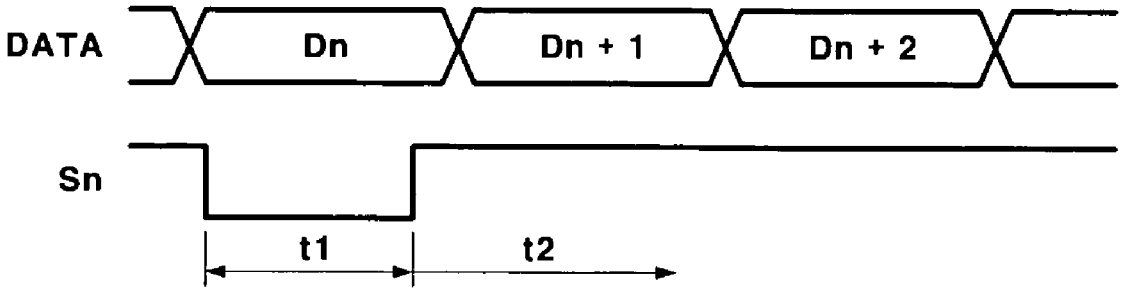
FIG. 5 shows a driving waveform for driving the pixel circuit of FIG. 4.

FIG. 4 shows an equivalent circuit diagram of a pixel circuit according to a first exemplary embodiment of the present invention, and FIG. 5 shows a driving waveform for driving the driving circuit of FIG. 4. For ease of description, the pixel circuit coupled to the m-th data line Dm and the n-th scan line Sn will be described.

As shown, the pixel circuit 10 according to the first exemplary embodiment of the present invention comprises an organic EL element OLED, transistors M1 to M6, and capacitors C1 and C2.

The transistor M1, coupled between a power $V_{DD}$ and the organic EL element OLED, controls the current flowing to the organic EL element OLED. The source electrode of the transistor M1 is coupled to the power $V_{DD}$, and its drain electrode is coupled to an anode of the organic EL element OLED through the transistor M4. A cathode of the organic EL element OLED is coupled to a power $V_{SS}$. Since the transistor M1 is realized with a P-type transistor, the power $V_{SS}$ supplies a lesser voltage than the power $V_{DD}$, such as a ground voltage.

The transistor M2 diode-connects the transistor M1 in response to a select signal provided from the scan line $S_n$.

The transistor M5 couples a first electrode of the capacitor C1 and the power VDD in response to the select signal applied to the scan line $S_n$, and a second electrode of the capacitor C1 is coupled to a gate electrode of the transistor M1.

A first electrode of the capacitor C2 is coupled to the power $V_{DD}$, and the transistor M6 couples a second electrode of the capacitor C2 to the first electrode of the capacitor C1 in response to a select signal applied to the scan line $S_n$.

The transistor M3 transmits the data voltage provided from the data line Dm to the second electrode of the capacitor C2 in response to a select signal provided from the scan line $S_n$.

The transistors M2, M3, and M5 may be formed with a first channel type, and the transistors M4 and M6 may be formed with a second channel type in the first exemplary embodiment.

Therefore, the transistors M4 and M6 are turned off when the transistors M2, M3, and M5 are turned on, and vice versa. In other words, with p-type transistors M2, M3, and M5 and n-type transistors M4 and M6, when a low level select signal is applied to the scan line Sn, the p-type transistors M2, M3, and M5 are turned on, and the n-type transistors M4 and M6 are turned off. Consequently, one select signal may control the five switching transistors M2-M6.

An operation of the pixel circuit according to the first exemplary embodiment will now be described with reference to FIG. 5, FIG.6 and FIG. 7.

Referring to FIG. 5, the transistors M2, M3, and M5 are turned on and the transistors M4 and M6 are turned off when a low level select signal is applied in the period of t1.

Figure 6:
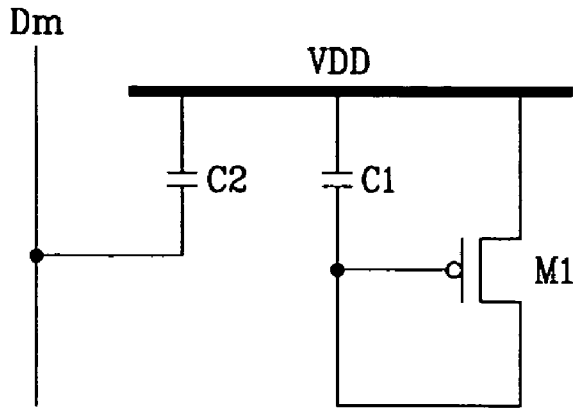
FIG. 6 shows an equivalent circuit of the pixel circuit shown in FIG. 4 during a period t1 of FIG. 5.

Therefore, as shown in FIG. 6, the first electrode of the capacitor C1 is coupled to the power VDD through the transistor M5, and the driving transistor M1 is diode-connected by the transistor M2. Hence, the capacitor C1 is charged with a voltage corresponding to the threshold voltage $V_{TH}$ at the transistor M1. Also, the second electrode of the capacitor C2 is coupled to the data line $D_m$, thereby charging the capacitor C2 with the data voltage. When a high level select signal is applied in the period t2, the transistors M4 and M6 are turned on, and the transistors M2, M3, and M5 are turned off.

Figure 7:
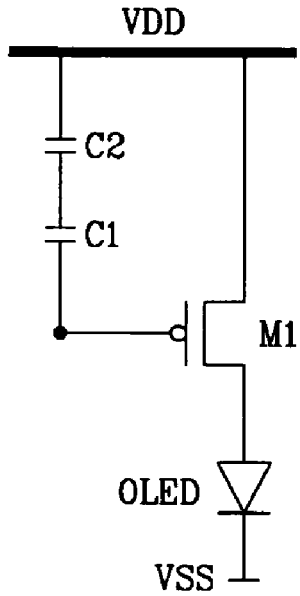
FIG. 7 shows an equivalent circuit of the pixel circuit shown in FIG. 4 during a period t2 of FIG. 5.

As shown in FIG. 7, the second electrode of the capacitor C2 is coupled to the first electrode of the capacitor C1 by the transistor M6, and the first electrode of the capacitor C2 is coupled to the power $V_{DD}$. Hence, since the capacitors C1 and C2 are coupled in series, the voltage applied to the gate of the transistor M1 substantially corresponds to the total of the voltage stored in the capacitor C1 plus the voltage stored in the capacitor C2.

In this instance, with the transistor M4 turned on, the current flowing to the driving transistor M1 is transmitted to the organic EL element OLED, and the organic EL element OLED displays an image corresponding to the applied current.

The current $I_{OLED}$ flowing to the organic EL element OLED is given in Equation 1.

$$I_{OLED}=\beta/2(V_{GS}-V_{TH})^2=\beta/2(V_{DD}-V_{TH}-V_{DATA}-|V_{TH}|)^2 \quad \text{Equation 1}$$

where $I_{OLED}$ is a current flowing to the organic EL element OLED, $V_{GS}$ is a voltage between the source electrode and the gate electrode of the transistor M1, $V_{TH}$ is a threshold voltage at the transistor M1, $V_{DATA}$ is a data voltage, and β is a constant.

Equation 1 may be expressed as Equation 2, where it is shown that the current $I_{OLED}$ flowing to the organic EL element OLED is not influenced by the deviation of the threshold voltage of the driving transistor M1.

$$I_{OLED}=\beta/2(V_{DD}-V_{DATA})^2 \quad \text{Equation 2}$$

Therefore, the threshold voltage deviation may be compensated and the pixel circuit may be driven by a single select signal according to the first embodiment, thereby reducing the complexity of the pixel circuit and the driving circuit, and obtaining the desired aperture ratio.

A pixel circuit according to a second exemplary embodiment of the present invention will now be described with reference to FIG. 8 and FIG. 9.

Figure 8:
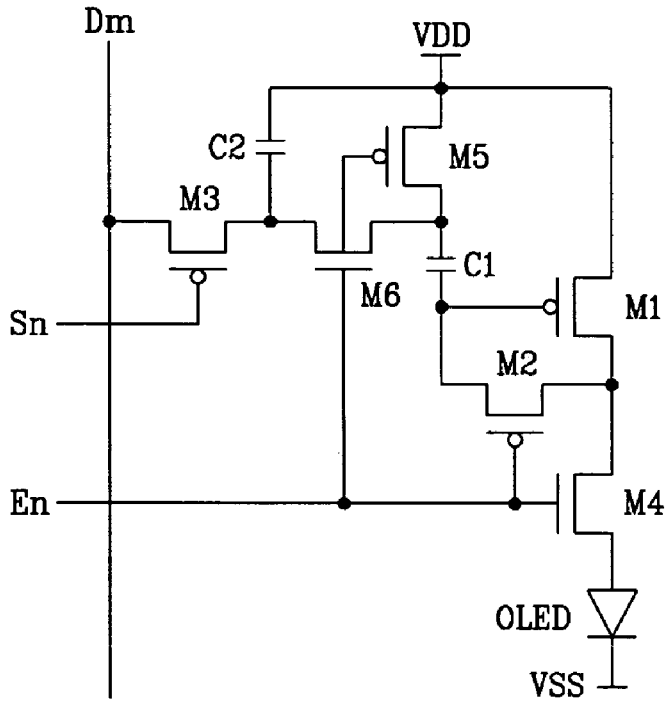
FIG. 8 shows a pixel circuit according to a second exemplary embodiment of the present invention.
Figure 9:
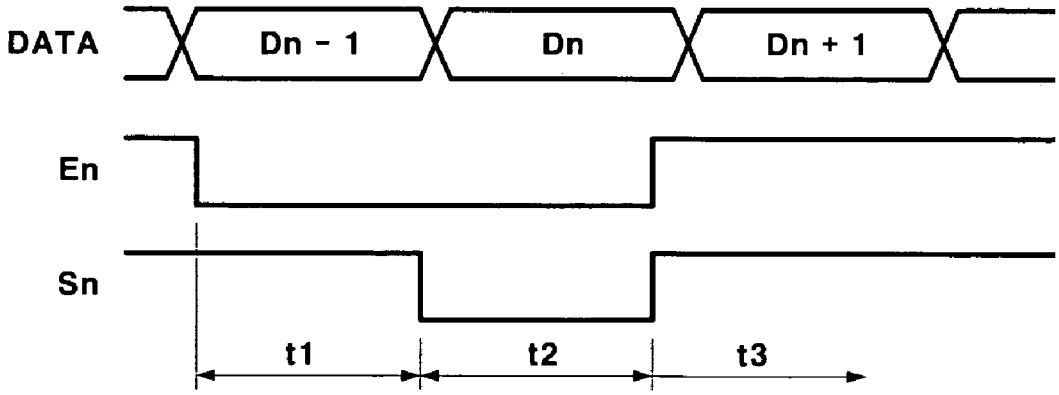
FIG. 9 shows a driving waveform for driving the pixel circuit shown in FIG. 8.

FIG. 8 shows a pixel circuit according to a second exemplary embodiment of the present invention, and FIG. 9 shows a driving waveform for driving the pixel circuit shown in FIG. 8.

The pixel circuit according to the second exemplary embodiment differs from the first exemplary embodiment in that separate select signals are applied to the transistor M3 and the transistors M2, M4, M5, and M6.

Specifically, a select signal from the scan line Sn is applied to the transistor M3, and a select signal from an additional scan line En is applied to the transistors M2, M4, M5, and M6. Accordingly, the threshold voltage of $V_{TH}$ at the driving transistor M1 is more precisely compensated by allowing different periods of the select signals from the scan line $S_n$ and the scan line $E_n$.

A driving method of the pixel circuit according to the second exemplary embodiment will now be described referring to FIG. 9.

When the select signal provided from the scan line En becomes low level in the period t1, the transistors M2 and M5 are turned on, the driving transistor M1 is diode-connected, and the first electrode of the capacitor C1 is coupled to the power $V_{DD}$. Therefore, the capacitor C1 is charged with the threshold voltage of $V_{TH}$ of the driving transistor M1, and the charging operation is consecutively performed during the period t2.

When the select signal from the scan line Sn becomes low level in the period t2, the transistor M3 turns on, and the data voltage from the data line $D_m$ is charged in the capacitor C2.

When the select signals become high level during the period t3, the capacitor C1 and the capacitor C2 are coupled in series in a manner like that of FIG. 7, and a current corresponding to the data voltage $V_{DATA}$ flows to the organic EL element OLED.

Separating the scan line Sn and the scan line En, and differentiating the periods of their respective select signals, may allow the capacitor C1 to be accurately charged with the threshold voltage of the driving transistor M1.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

For example, in FIG. 4 and FIG. 8, the transistor M1 may be realized with active elements that include a first electrode, a second electrode, and a third electrode, where a difference of the voltages between the first and second electrodes controls the current output to the third electrode. Also, the transistors M2, M3, M4, and M5 are elements for switching both coupled terminals according to applied control signals, and they are not restricted to the specific elements shown in FIG. 4 and FIG. 8.

Figure 10:
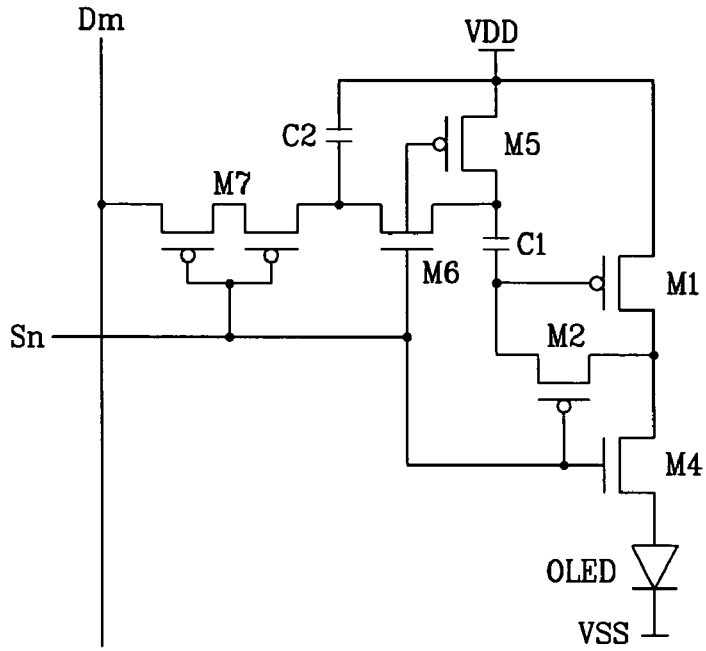
FIG. 10 shows a pixel circuit according to a third exemplary embodiment of the present invention.
Figure 11:
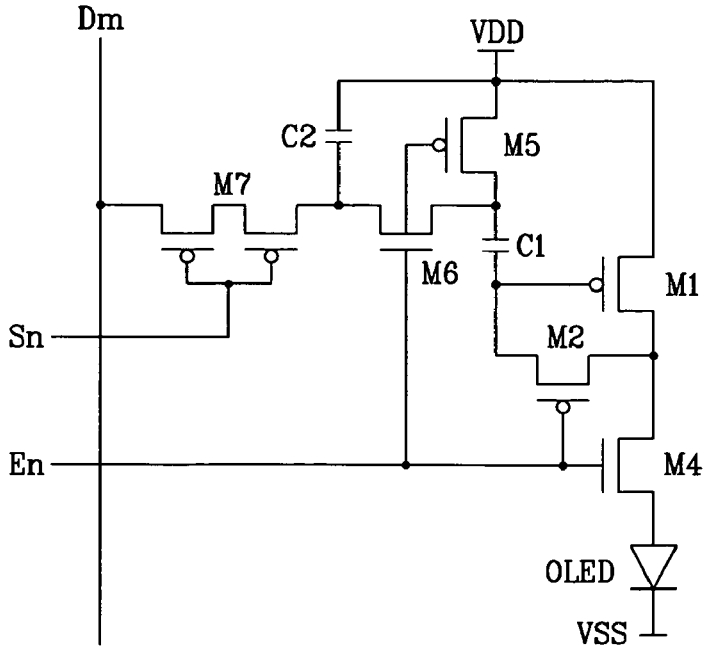
FIG. 11 shows a pixel circuit according to a fourth exemplary embodiment of the present invention.

Further, FIG. 4 and FIG. 8 show the transistor M3 having one gate electrode, however, the transistor M3 may be replaced with dual gate transistor (M7) as shown in FIG. 10 and FIG. 11 to reduce leakage current.

What is claimed is:

1. An image display device, comprising:

a data line for transmitting a data voltage corresponding to an image signal;

a scan line for transmitting a select signal; and a pixel circuit coupled to the data line and the scan line, wherein the pixel circuit comprises:

a display element;

a first transistor having a first electrode, a second electrode coupled to a power, and a third electrode coupled to the display element;

a first switch for diode-connecting the first transistor in response to the select signal;

a second switch for coupling a first electrode of a first capacitor to the power in response to the select signal;

a second electrode of the first capacitor coupled to the first electrode of the first transistor;

a second capacitor having a first electrode coupled to the power;

a third switch for transmitting the data voltage to a second electrode of the second capacitor in response to the select signal; and a fourth switch, coupled between the first electrode of the first capacitor and the second electrode of the second capacitor, for intercepting the first electrode of the first capacitor and the second electrode of the second capacitor in response to the select signal.

2. The image display device of claim 1, further comprising:

a fifth switch, coupled between the third electrode of the first transistor and the display element, for intercepting the third electrode of the first transistor and the display element in response to the select signal.

3. The image display device of claim 1, wherein the first switch, the second switch, and the third switch are a first type transistor.

4. The image display device of claim 3, wherein the fourth switch and the fifth switch are a second type transistor.

5. The image display device of claim 4, wherein the pixel circuit operates in an order of a first period for applying the select signal and a second period for applying a no-select signal.

6. The image display device of claim 5, wherein during the first period, a voltage corresponding to a threshold voltage at the first transistor is stored in the first capacitor, and the data voltage is stored in the second capacitor, and wherein during the second period, the voltage stored in the first capacitor and the voltage stored in the second capacitor are applied to the first electrode of the first transistor.

7. The image display device of claim 1, wherein the third switch is a dual gate transistor.

8. An image display device, comprising:

a data line for transmitting a data voltage corresponding to an image signal;

a first scan line for transmitting a select signal;

a second scan line for transmitting a control signal; and a pixel circuit coupled to the data line and the first scan line, and the second scan line, wherein the pixel circuit comprises:

a display element for displaying an image corresponding to an applied current;

a first transistor, including a first electrode, a second electrode coupled to a power, and a third electrode coupled to the display element;

a first switch for diode-connecting the first transistor in response to a first control signal;

a second switch for coupling a first electrode of a first capacitor to the power in response to a second control signal;

a second electrode of the first capacitor coupled to the first electrode of the first transistor;

a second capacitor having a first electrode coupled to the power;

a third switch for transmitting the data voltage to a second electrode of the second capacitor in response to the select signal; and a fourth switch, coupled between the first electrode of the first capacitor and the second electrode of the second capacitor, for intercepting the first electrode of the first capacitor and the second electrode of the second capacitor in response to a third control signal.

9. The image display device of claim 8, further comprising:

a fifth switch, coupled between the third electrode of the first transistor and the display element, for intercepting the third electrode of the first transistor and the display element in response to a fourth control signal.

10. The image display device of claim 9, wherein the first to fourth control signals are substantially the same.

11. The image display device of claim 10, wherein the first switch, the second switch, and the third switch are a first type of transistor, wherein the fourth switch and the fifth switch are a second type of transistor.

12. The image display device of claim 11, wherein the pixel circuit operates in an order of a first period for applying a control signal, a second period for applying the control signal and the select signal, and a third period for applying neither of the control signal or the select signal.

13. The image display device of claim 12, wherein during the first period, a voltage corresponding to a threshold voltage at the first transistor is stored in the first capacitor, wherein during the second period, the data voltage is stored in the second capacitor, and wherein during the third period, the voltage stored in the first capacitor and the voltage stored in the second capacitor are applied to the first electrode of the first transistor.

14. A method for driving an image display device including a data line for transmitting a data voltage corresponding to an image signal, a scan line for transmitting a select signal, and a pixel circuit coupled to the data line and the scan line, wherein the pixel circuit comprises: a driving transistor having a first electrode, a second electrode coupled to a power, and a third electrode; a display element coupled to the third electrode of the driving transistor; a first capacitor having a second electrode coupled to the first electrode of the driving transistor; and a second capacitor having a first electrode coupled to the power, said method comprising:

diode-connecting the driving transistor, coupling a first electrode of the first capacitor to the power, and coupling a second electrode of the second capacitor to the data line during a first period, and coupling the first electrode of the first capacitor and the second electrode of the second capacitor during a second period, wherein the first electrode of the first capacitor is electrically intercepted from the second electrode of the second capacitor during the first period.

15. The method of claim 14, further comprising:

electrically intercepting the third electrode of the driving transistor and the display element during the first period.

16. A method for driving an image display device including a data line for transmitting a data voltage corresponding to an image signal, a first scan line for transmitting a select signal, a second scan line for transmitting a control signal, and a pixel circuit coupled to the data line, the first scan line, and the second scan line, wherein the pixel circuit comprises: a driving transistor having a first electrode, a second electrode coupled to a power, and a third electrode; a display element coupled to the third electrode of the driving transistor; a first capacitor having a second electrode coupled to the first electrode of the driving transistor; and a second capacitor having a first electrode coupled to the power, comprising:

diode-connecting the driving transistor, and coupling a first electrode of the first capacitor to the power during a first period, coupling a second electrode of the second capacitor to the data line during a second period, and coupling the first electrode of the first capacitor to the second electrode of the second capacitor during a third period, wherein the first electrode of the first capacitor is electrically intercepted from the second electrode of the second capacitor during the first period and the second period.

17. A method for driving an image display device including a data line for transmitting a data voltage corresponding to an image signal, a scan line for transmitting a select signal, and a pixel circuit coupled to the data line and the scan line, wherein the pixel circuit comprises: a driving transistor having a first electrode, a second electrode coupled to a power, and a third electrode; a display element coupled to the third electrode of the driving transistor; a first capacitor having a second electrode coupled to the first electrode of the driving transistor; and a second capacitor having a first electrode coupled to the power, comprising:

storing a threshold voltage at the driving transistor in the first capacitor and storing a data voltage in the second capacitor during a first period, and coupling the first capacitor and the second capacitor in series so that the voltage stored in the first capacitor and the voltage stored in the second capacitor may be applied to the first electrode of the driving transistor during a second period, wherein the first electrode of the first capacitor is electrically intercepted from the second electrode of the second capacitor during the first period.

* * * * *